US005904280A

United States Patent [19]

Chan

[11] Patent Number: 5,904,280

[45] Date of Patent: May 18, 1999

[54] WRIST—MOUNTABLE DEVICE

[75] Inventor: Hsiang Ho Chan, Taipei, Taiwan

[73] Assignee: B.K. Rekhatex (H.K.) Ltd., Central, The Hong Kong Special Administrative Region of the People's Republic of China

[21] Appl. No.: 08/883,514

[22] Filed: Jun. 26, 1997

[51] Int. Cl.[6] ..... A45F 5/00

[52] U.S. Cl. ..... 224/219; 224/183; 224/222; 224/267; 224/162; 224/930; 362/103; 362/191

[58] Field of Search ..... 224/183, 191, 224/162, 181, 267, 217, 222, 904, 901, 901.2, 901.4, 929, 930; 362/103, 105, 190, 191, 119, 120, 285, 287, 288; 33/760; D10/70, 71

[56] References Cited

U.S. PATENT DOCUMENTS

| | | | |
|---|---|---|---|
| 1,274,312 | 7/1918 | Nicoll | 244/222 |
| 4,253,134 | 2/1981 | Barnaby | 362/120 |
| 4,425,600 | 1/1984 | Barnhart | 362/103 |
| 4,826,059 | 5/1989 | Bosch et al. | 224/904 |
| 5,103,384 | 4/1992 | Drohan | 362/191 |
| 5,183,193 | 2/1993 | Brandell | 224/219 |
| 5,257,729 | 11/1993 | Silvernail | 224/219 |
| 5,544,420 | 8/1996 | Choi | 362/120 |
| 5,797,670 | 8/1998 | Snoke et al. | 362/191 |

FOREIGN PATENT DOCUMENTS

| | | | |
|---|---|---|---|
| 30395 | of 1910 | United Kingdom | 224/183 |

*Primary Examiner*—Gregory M. Vidovich
*Attorney, Agent, or Firm*—Leydig, Voit & Mayer

[57] ABSTRACT

A wrist-mountable device comprising a body having a top surface and a strap for holding the body onto the wrist of a user. A magnet is provided underneath the top surface for holding, by way of magnetic attraction, objects such as screws or nails onto the top surface. A light source is connected to the body by means of an adjustably bendable elongate connector.

7 Claims, 2 Drawing Sheets

WRIST— MOUNTABLE DEVICE

The present invention relates to a wrist-mountable device for use by a person carrying out fixing work.

SUMMARY OF THE INVENTION

According to the invention, there is provided a wrist-mountable device comprising a body having a top surface, means for holding the body onto the wrist of a user, a magnetic holder for holding, by way of magnetic attraction, an object to the body top surface, and a light source supported by the body for illumination.

Preferably, said holding means is adapted to extend around at least one side of the wrist in order to hold the body onto the opposite side of the wrist.

More preferably, said holding means comprises a hook-and-loop fastening strap.

It is preferred that the magnetic holder is provided inside the body at a position immediately below the top surface.

In a preferred embodiment, the light source is movable relative to the body for determining the angle at which it is to illuminate.

More preferably, the light source is connected to the body by means of an adjustably bendable elongate connector.

Further more preferably, the body is formed with an external groove for accommodating the light and the connector when the connector is bent close to the body.

It is preferred that the wrist-mountable device includes a measuring tape supported by the body for extending out in the forward direction from the body.

More preferably, the measuring tape is positioned on substantially the same side of the body as a thumb of the user for manipulation by the thumb.

In a preferred embodiment, the wrist-mountable device includes a clip on the body for holding an elongate object.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1:
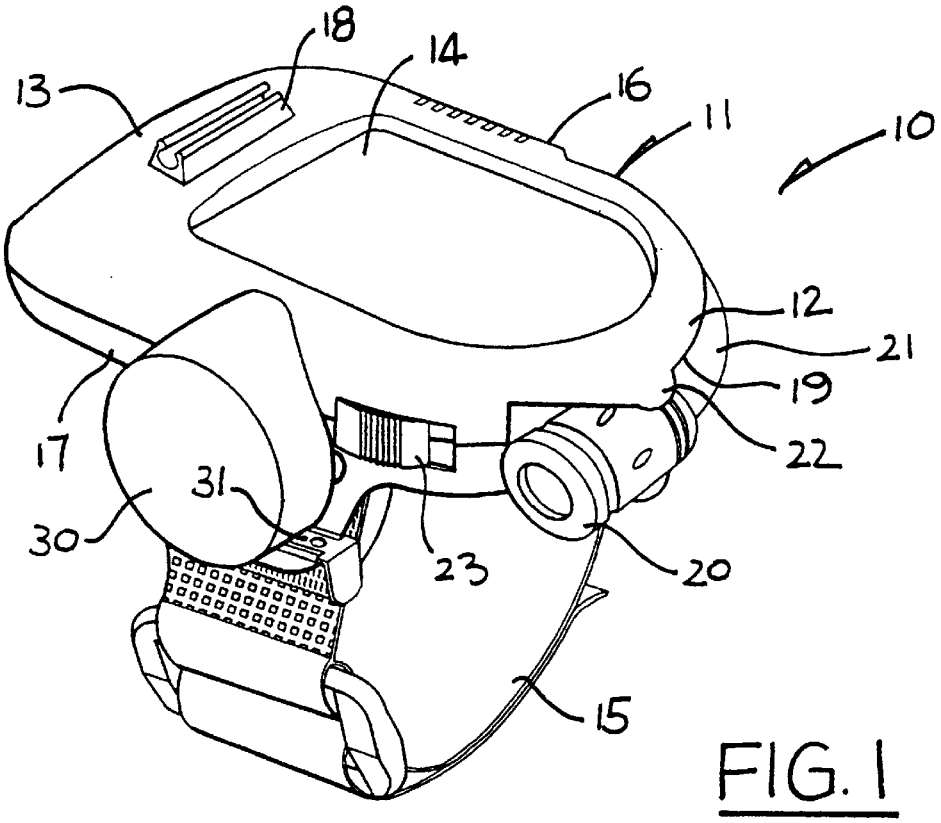
FIG. 1 is a perspective view of an embodiment of a wrist-mountable device in accordance with the invention.

Referring to the drawings, there is shown a wrist-mountable device 10 embodying the invention, which device 10 has a generally flat plastic body 11 having front and rear ends 12 and 13 and a generally flat recessed top surface 14. The body 11 is provided with a bottom wrist holder 15 which extends from one lateral side 16 to the opposite side 17 of and forms a loop with the body 11 for mounting the overall device 10 onto the (left) wrist of a user, in the manner like wearing a wrist-watch. The wrist holder 15 may take the form of a hooked-and-looped fastening strap (as shown), an elastic and/or expandable band, a clip or the like. A magnet 9 is provided inside the body 11 at a position immediately below the top surface 14 for holding small fasteners, such as screws, bolts, nuts, nails, pins or the like, onto the surface 14 by way of magnetic attraction. The rear end 13 of the body 11 is provided with a laterally extending C-shaped clip 18 for holding an elongate object such as a screw driver, a pencil or the like.

Figure 2:
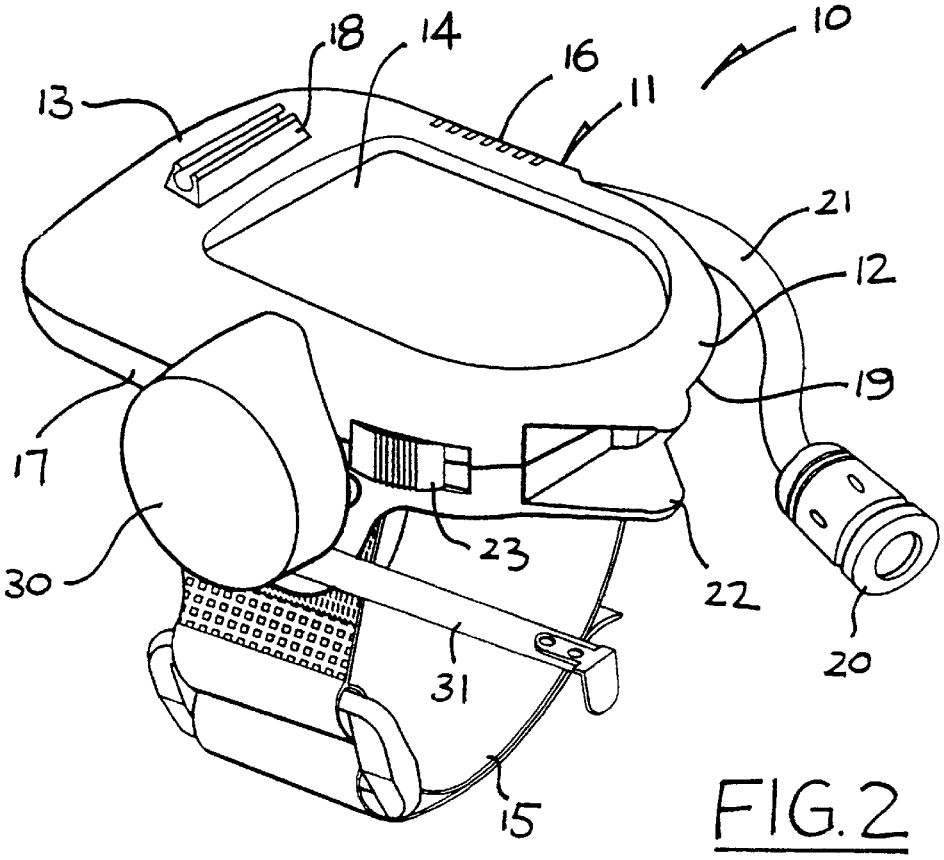
FIG. 2 is a perspective view corresponding to FIG. 1, showing the wrist-mountable device in an in-use condition.
Figure 3:
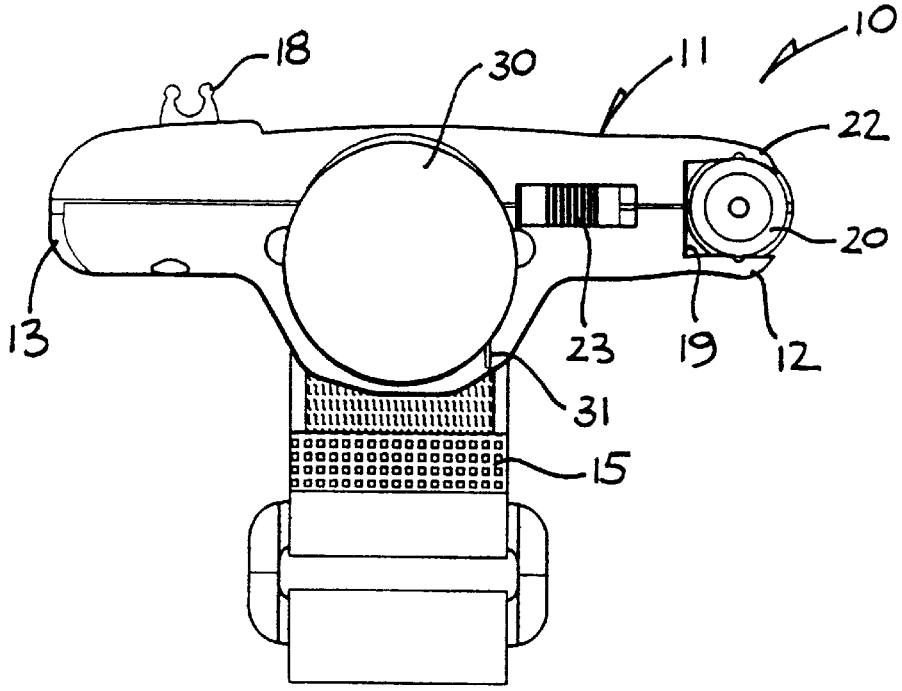
FIG. 3 is a side elevational view of the wrist-mountable device of FIG. 1.
Figure 4:
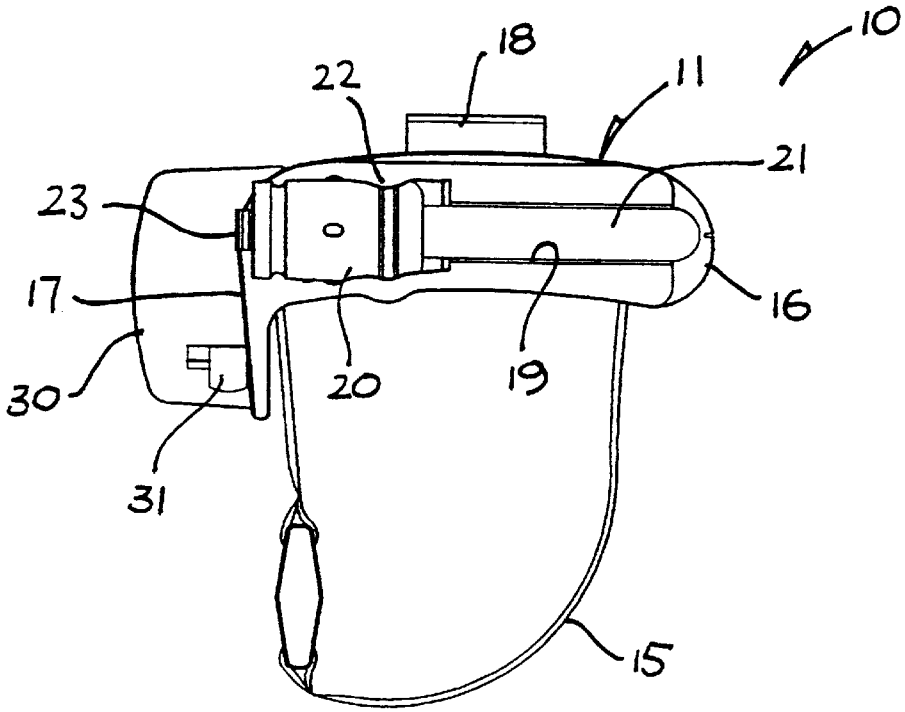
FIG. 4 is a front end elevational view of the wrist-mountable device of FIG. 1.

The wrist-mountable device 10 incorporates a light 20 for illumination, which is connected to the side 16 of the body 11 by means of an adjustably flexible/bendable elongate connector 21. The connector 21 is bendable, relative to the body 11, to change and maintain the angle at which the light 20 is to illuminate and/or the position of the light 20 for illumination. As shown in FIG. 2, the connector 21 is capable of being bent into and maintaining an inflected curved shape. The body 11 is formed with a peripheral groove 19 having a front end clip 22, which extends from the body side 16 to the body front end 12 for accommodating the light 20 (to be clasped by the clip 22) and the connector 21 when the connector 21 is bent to lie close against the body 11.

Two battery cells (not shown) are contained inside the body rear end 13 for energizing the light 20. The light 20 is switchable on and off by means of an electrical slide switch 23 provided on the body side 17. The switch 23 may be replaced by a normally-closed press switch provided inside the clip 22 of the groove 19 for automatically switching on the light 20 when the light 20 is moved out of the groove 19.

The wrist-mountable device 10 further includes a tape measure 30 incorporating a measuring tape 31. The tape 31 is provided on the side 17 of the body 11, which is the same side as where the thumb of a user will be when the device 10 is mounted on the user's left wrist. The tape 31 is arranged to extend out in the forward direction such that it may readily and conveniently be reached by the left thumb and index finger of the user for holding the rear end of the extended tape 31.

The wrist-mountable device 10 enables hands-free support of said small fasteners by means of the magnetic attraction produced by the magnetic surface 14 and said elongate objects by means of the clip 18, as well as hands-free illumination by means of the light 20 of the place where fixing work is to carry out. These functions leave both hands of the user free for carrying out the actual fixing work. The provision of the tape measure 30 and its position add extra convenience. Although the wrist-mountable device 10 is designed particularly for use on the left wrist of a user (by reason of the position of the tape measure 30), it may be used on the right wrist.

The invention has been given by way of example only, and various other modifications of and/or alterations to the described embodiment may be made by persons skilled in the art without departing from the scope of the invention as specified in the appended claims.

What is claimed is:

1. A wrist-mountable device comprising a body having a top surface and an external groove, means for holding the body onto the wrist of a user, a magnetic holder for holding, by magnetic attraction, an object to the body top surface, and a light source supported by the body for illumination and connected to the body by an adjustable bendable elongate connector enabling the light source to move relative to the body for adjusting an angle of illumination of the light source, the external groove in the body being capable of accommodating the light source and the connector when the connector is bent close to the body.

2. A wrist-mountable device as claimed in claim 1, wherein said holding means is adapted to extend around at least one side of the wrist in order to hold the body onto the opposite side of the wrist.

3. A wrist-mountable device as claimed in claim 2, wherein said holding means comprises a hook-and-loop fastening strap.

4. A wrist-mountable device as claimed in claim 1, wherein the magnetic holder is provided inside the body at a position immediately below the top surface.

5. A wrist-mountable device as claimed in claim 1, further including a measuring tape supported by the body for extending out in a forward direction from the body.

6. A wrist-mountable device as claimed in claim 5, wherein the measuring tape is positioned on substantially the same side of the body as a thumb of the user for manipulation by the thumb.

7. A wrist-mountable device as claimed in claim 1, including a clip on the body for holding an elongate object.

* * * * *